US012576313B2

(12) United States Patent
Kubacak et al.

(10) Patent No.: US 12,576,313 B2
(45) Date of Patent: Mar. 17, 2026

(54) DEVICE TO RELEASABLY SECURE PICKLEBALLS

(71) Applicant: Hyperlith, LLC, Bellmead, TX (US)

(72) Inventors: Collin Kubacak, Bellmead, TX (US); Guyanne Nichols, Austin, TX (US); Curtis Cathey, Manchaca, TX (US)

(73) Assignee: Hyperlith, LLC, Bellmead, TX (US)

( * ) Notice: Subject to any disclaimer, the term of this patent is extended or adjusted under 35 U.S.C. 154(b) by 79 days.

(21) Appl. No.: 18/583,508

(22) Filed: Feb. 21, 2024

(65) Prior Publication Data

US 2024/0278087 A1 Aug. 22, 2024

Related U.S. Application Data

(60) Provisional application No. 63/447,331, filed on Feb. 21, 2023.

(51) Int. Cl.
*A63B 47/00* (2006.01)
*A63B 102/08* (2015.01)

(52) U.S. Cl.
CPC ..... *A63B 47/001* (2013.01); *A63B 2102/08* (2015.10)

(58) Field of Classification Search
CPC ..... A63B 1/00; A63B 15/00; A63B 15/005; A63B 2022/0033; A63B 2022/0041; A63B 2022/0092; A63B 2022/0094; A63B 2022/0278; A63B 2022/0641; A63B 2022/0658; A63B 2022/067; A63B 2023/006; A63B 2024/0009; A63B 2024/0012; A63B 2024/0025; A63B 2024/0028; A63B 2024/0031; A63B 2024/0034; A63B 2024/0037; A63B 2024/0043; A63B 2024/0053; A63B 2024/0056; A63B 2024/0065; A63B 2024/0068; A63B 2024/0071; A63B 2024/0093; A63B 2024/0096; A63B 2037/085; A63B 2037/087; A63B 2037/125; A63B 2041/005; A63B 2043/001; A63B 2047/004; A63B 2049/0201; A63B 2049/0202; A63B 2049/0203; A63B 2049/0204;
(Continued)

(56) References Cited

U.S. PATENT DOCUMENTS 3,143,265 A * 8/1964 Ruderian ..... A63B 57/20 294/142
D792,932 S * 7/2017 Taylor ..... D21/780
(Continued)

FOREIGN PATENT DOCUMENTS

DE 4133987 A1 * 4/1993 ..... A63B 71/0672
GB 2279228 A * 1/1995 ..... A44C 15/00

*Primary Examiner* — Anthony D Stashick
*Assistant Examiner* — Marcos Javier Rodriguez Molina

(57) ABSTRACT

A pickleball holder may include a shaft and a spring mechanism. The shaft may have a diameter sized to fit through one or more holes in a pickleball. The spring mechanism may be at least partially within the shaft and may be configured to compress as the spring mechanism passes through a hole of the one or more holes and to expand when the spring mechanism is outside of the hole to releasably secure one or more pickleballs. In some embodiments, the pickleball holder may include a cord coupled to an end of the shaft.

20 Claims, 5 Drawing Sheets

(58) Field of Classification Search
CPC .... A63B 2049/0207; A63B 2049/0211; A63B 2049/0212; A63B 2049/0217; A63B 2049/103; A63B 2053/0479; A63B 2053/0491; A63B 2053/0495; A63B 2063/001; A63B 2063/086; A63B 2067/063; A63B 2069/0006; A63B 2069/0008; A63B 2069/0011; A63B 2069/401; A63B 2069/402; A63B 2071/0063; A63B 2071/0072; A63B 2071/0081; A63B 2071/024; A63B 2071/025; A63B 2071/026; A63B 2071/027; A63B 2071/0602; A63B 2071/0625; A63B 2071/0627; A63B 2071/063; A63B 2071/0633; A63B 2071/0638; A63B 2071/0647; A63B 2071/065; A63B 2071/0655; A63B 2071/0658; A63B 2071/0666; A63B 2071/068; A63B 2071/0683; A63B 2071/0694; A63B 2071/1258; A63B 21/0004; A63B 21/00043; A63B 21/00061; A63B 21/00065; A63B 21/00069; A63B 21/00072; A63B 21/00076; A63B 21/00178; A63B 21/00181; A63B 21/00185; A63B 21/0058; A63B 21/0083; A63B 21/012; A63B 21/015; A63B 21/023; A63B 21/025; A63B 21/026; A63B 21/028; A63B 21/04; A63B 21/0421; A63B 21/0428; A63B 21/0442; A63B 21/045; A63B 21/05; A63B 21/055; A63B 21/0552; A63B 21/0557; A63B 21/06; A63B 21/0603; A63B 21/0608; A63B 21/0615; A63B 21/0616; A63B 21/0618; A63B 21/062; A63B 21/0624; A63B 21/0628; A63B 21/063; A63B 21/065; A63B 21/068; A63B 21/072; A63B 21/0724; A63B 21/0726; A63B 21/0728; A63B 21/075; A63B 21/078; A63B 21/08; A63B 21/151; A63B 21/153; A63B 21/154; A63B 21/16; A63B 21/1663; A63B 21/169; A63B 21/22; A63B 21/225; A63B 21/4009; A63B 21/4015; A63B 21/4017; A63B 21/4019; A63B 21/4025; A63B 21/4029; A63B 21/4033; A63B 21/4034; A63B 21/4035; A63B 21/4037; A63B 21/4039; A63B 21/4043; A63B 21/4045; A63B 21/4047; A63B 21/4049; A63B 2102/00; A63B 2102/02; A63B 2102/04; A63B 2102/06; A63B 2102/065; A63B 2102/08; A63B 2102/14; A63B 2102/16; A63B 2102/18; A63B 2102/182; A63B 2102/20; A63B 2102/22; A63B 2102/24; A63B 2102/32; A63B 22/0005; A63B 22/001; A63B 22/0012; A63B 22/0015; A63B 22/0023; A63B 22/0046; A63B 22/0056; A63B 22/02; A63B 22/0214; A63B 22/0235; A63B 22/025; A63B 22/0257; A63B 22/0285; A63B 22/0292; A63B 22/04; A63B 22/0605; A63B 22/0664; A63B 22/14; A63B 22/16; A63B 22/18; A63B 22/20; A63B 22/203; A63B 2208/0204; A63B 2208/0233; A63B 2208/0252; A63B 2208/12; A63B 2209/00; A63B 2209/02; A63B 2209/023; A63B 2209/08; A63B 2209/10; A63B 2209/14; A63B 2210/50; A63B 2210/52; A63B 2210/58; A63B 2214/00; A63B 2220/05; A63B 2220/10; A63B 2220/12; A63B 2220/13; A63B 2220/16; A63B 2220/17; A63B 2220/18; A63B 2220/20; A63B 2220/24; A63B 2220/30; A63B 2220/34; A63B 2220/35; A63B 2220/40; A63B 2220/44; A63B 2220/50; A63B 2220/51; A63B 2220/52; A63B 2220/53; A63B 2220/54; A63B 2220/56; A63B 2220/58; A63B 2220/62; A63B 2220/64; A63B 2220/72; A63B 2220/75; A63B 2220/76; A63B 2220/80; A63B 2220/801; A63B 2220/803; A63B 2220/805; A63B 2220/806; A63B 2220/807; A63B 2220/808; A63B 2220/833; A63B 2220/836; A63B 2220/89; A63B 2225/01; A63B 2225/055; A63B 2225/09; A63B 2225/093; A63B 2225/15; A63B 2225/20; A63B 2225/30; A63B 2225/305; A63B 2225/50; A63B 2225/52; A63B 2225/54; A63B 2225/60; A63B 2225/605; A63B 2225/62; A63B 2225/64; A63B 2225/682; A63B 2225/685; A63B 2225/687; A63B 2225/74; A63B 2230/00; A63B 2230/01; A63B 2230/06; A63B 2230/42; A63B 2230/436; A63B 2230/60; A63B 2230/75; A63B 2243/0025; A63B 2243/0033; A63B 2243/0037; A63B 2243/0054; A63B 2243/0066; A63B 2243/007; A63B 2243/0095; A63B 2244/10; A63B 23/00; A63B 23/02; A63B 23/0211; A63B 23/03508; A63B 23/03525; A63B 23/03533; A63B 23/03541; A63B 23/0355; A63B 23/03575; A63B 23/0405; A63B 23/0429; A63B 23/047; A63B 23/0476; A63B 23/0494; A63B 23/08; A63B 23/085; A63B 23/12; A63B 23/1209; A63B 23/1218; A63B 23/1236; A63B 23/1245; A63B 23/1281; A63B 23/14; A63B 23/16; A63B 24/00; A63B 24/0003; A63B 24/0006; A63B 24/0021; A63B 24/0062; A63B 24/0075; A63B 24/0084; A63B 24/0087; A63B 26/003; A63B 37/00; A63B 37/0001; A63B 37/0002; A63B 37/0003; A63B 37/0004; A63B 37/0005; A63B 37/0006; A63B 37/00065; A63B 37/0007; A63B 37/0009; A63B 37/001; A63B 37/0011; A63B 37/0012; A63B 37/0013; A63B 37/0015; A63B 37/0016; A63B 37/0017; A63B 37/0018; A63B 37/0019; A63B 37/002; A63B 37/0021; A63B 37/00215; A63B 37/0022; A63B 37/00221; A63B 37/00222; A63B 37/00223; A63B 37/0023; A63B 37/0024; A63B 37/0026; A63B 37/0027; A63B 37/0029; A63B 37/003; A63B 37/0031; A63B 37/0032; A63B 37/0033; A63B 37/0034; A63B 37/0035; A63B 37/0036; A63B 37/0037; A63B 37/0038; A63B 37/0039; A63B 37/0041; A63B 37/0043; A63B 37/0045; A63B 37/0046; A63B 37/0047; A63B 37/0048; A63B 37/0049; A63B 37/005; A63B 37/0051; A63B 37/0052; A63B 37/0053; A63B 37/0054; A63B 37/0055; A63B 37/0056; A63B 37/0058; A63B 37/0059; A63B 37/006; A63B 37/0061; A63B 37/0062; A63B 37/00621; A63B 37/00622; A63B 37/0063; A63B 37/0064; A63B 37/0065; A63B 37/0066; A63B 37/0067; A63B 37/0068; A63B 37/0069; A63B 37/007; A63B 37/0073; A63B 37/0074; A63B 37/0075; A63B 37/0076; A63B 37/0077; A63B 37/00776; A63B 37/0078; A63B 37/008; A63B 37/0082; A63B 37/0083; A63B 37/0084; A63B 37/0086; A63B 37/0087; A63B 37/0088; A63B 37/0089; A63B 37/009; A63B 37/0091; A63B 37/0092; A63B 37/00921; A63B 37/00922; A63B 37/0093; A63B 37/0094; A63B 37/0095; A63B 37/0096; A63B 37/0097; A63B 37/02; A63B 37/04; A63B 37/06; A63B 37/08; A63B 37/12; A63B 37/14; A63B 39/00; A63B 39/025; A63B 39/06; A63B 39/08; A63B 41/00; A63B 41/02; A63B 41/04; A63B 41/08; A63B 41/085; A63B 41/10; A63B 41/12; A63B 43/00; A63B 43/002; A63B 43/004; A63B 43/005; A63B 43/007; A63B 43/008; A63B 43/02; A63B 43/04; A63B 43/06; A63B 45/00; A63B 45/02; A63B 47/00; A63B 47/001; A63B 47/002; A63B 47/007; A63B 47/008; A63B 47/02; A63B 47/025; A63B 47/04; A63B 49/00; A63B 49/02; A63B 49/022; A63B 49/025; A63B 49/028; A63B 49/03; A63B 49/035; A63B 49/038; A63B 49/08; A63B 49/10; A63B 49/11; A63B 49/12; A63B 49/14; A63B 5/16; A63B 5/20; A63B 51/00; A63B 51/004; A63B 51/005; A63B 51/015; A63B 51/02; A63B 51/023; A63B 51/026; A63B 51/04; A63B 51/06; A63B 51/08; A63B 51/10; A63B 51/11; A63B 51/12; A63B 51/14; A63B 51/16; A63B 53/00; A63B 53/005; A63B 53/007; A63B 53/02; A63B 53/022; A63B 53/023; A63B 53/025; A63B 53/026; A63B 53/028; A63B 53/04; A63B 53/0408; A63B 53/0412; A63B 53/0416; A63B 53/042; A63B 53/0425; A63B 53/0429; A63B 53/0433; A63B 53/0437; A63B 53/0441; A63B 53/0445; A63B 53/045; A63B 53/0454; A63B 53/0458; A63B 53/0462; A63B 53/0466; A63B 53/047; A63B 53/0475; A63B 53/0487; A63B 53/06; A63B 53/065; A63B 53/08; A63B 53/10; A63B 53/12; A63B 53/14; A63B 55/00; A63B 55/20; A63B 55/408; A63B 55/60; A63B 57/00; A63B 57/0006; A63B 57/0037; A63B 57/10; A63B 57/12; A63B 57/13; A63B 57/15; A63B 57/20; A63B 57/203; A63B 57/207; A63B 57/353; A63B 57/357; A63B 57/40; A63B 57/50; A63B 57/60; A63B 59/00; A63B 59/20; A63B 59/30; A63B 59/40; A63B 59/50; A63B 59/51; A63B 59/54; A63B 59/56; A63B 59/70; A63B 59/80; A63B 60/00; A63B 60/002; A63B 60/006; A63B 60/0081; A63B 60/0085; A63B 60/02; A63B 60/04; A63B 60/06; A63B 60/08; A63B 60/10; A63B 60/12; A63B 60/14; A63B 60/16; A63B 60/20; A63B 60/22; A63B 60/24; A63B 60/26; A63B 60/28; A63B 60/32; A63B 60/34; A63B 60/40; A63B 60/42; A63B 60/46; A63B 60/48; A63B 60/50; A63B 60/52; A63B 60/54; A63B 60/64; A63B 63/00; A63B 63/004; A63B 63/007; A63B 63/06; A63B 63/08; A63B 63/083; A63B 65/06; A63B 65/12; A63B 65/122; A63B 67/002; A63B 67/02; A63B 67/04; A63B 67/06; A63B 67/08; A63B 67/083; A63B 67/10; A63B 67/187; A63B 67/20; A63B 67/22; A63B 69/00; A63B 69/0002; A63B 69/0015; A63B 69/002; A63B 69/0024; A63B 69/0026; A63B 69/0028; A63B 69/0053; A63B 69/0057; A63B 69/0059; A63B 69/0062; A63B 69/0064; A63B 69/0071; A63B 69/0073; A63B 69/0075; A63B 69/0079; A63B 69/0084; A63B 69/0086; A63B 69/0088; A63B 69/0091; A63B 69/0093; A63B 69/0095; A63B 69/0097; A63B 69/16; A63B 69/18; A63B 69/222; A63B 69/305; A63B 69/34; A63B 69/36; A63B 69/3605; A63B 69/3608; A63B 69/3614; A63B 69/3617; A63B 69/362; A63B 69/3621; A63B 69/3623; A63B 69/3632; A63B 69/3635; A63B 69/3655; A63B 69/3658; A63B 69/3661; A63B 69/3667; A63B 69/3676; A63B 69/3682; A63B 69/3685; A63B 69/3688; A63B 69/38; A63B 69/385; A63B 69/40; A63B 69/406; A63B 69/407; A63B 69/408; A63B 69/409; A63B 71/0009; A63B 71/0036; A63B 71/0045; A63B 71/0054; A63B 71/022; A63B 71/023; A63B 71/03; A63B 71/06; A63B 71/0605; A63B 71/0619; A63B 71/0622; A63B 71/0669; A63B 71/0672; A63B 71/0686; A63B 71/081; A63B 71/10; A63B 71/1225; A63B 71/141; A63B 71/143; A63B 9/00; A63H 17/21; A63H 2027/1033; A63H 2027/1041; A63H 2027/1083; A63H 27/10; A63H 33/04; A63H 33/065; A63H 33/08; A63H 33/082; A63H 33/086; B65D 1/095; B65D 1/225; B65D 1/26; B65D 1/265; B65D 1/30; B65D 1/34; B65D 1/38; B65D 11/10; B65D 11/105; B65D 11/14; B65D 11/18; B65D 11/1833; B65D 11/1846; B65D 11/1866; B65D 11/22; B65D 11/26; B65D 13/04; B65D 19/0002; B65D 19/0004; B65D 19/0012; B65D 19/0014; B65D 19/0016; B65D 19/0018; B65D 19/0024; B65D 19/0026; B65D 19/0028; B65D 19/0053; B65D 19/0071; B65D 19/0093; B65D 19/0097; B65D 19/02; B65D 19/06; B65D 19/10; B65D 19/12; B65D 19/16; B65D 19/18; B65D 19/38; B65D 19/385; B65D 19/40; B65D 19/42; B65D 19/44; B65D 21/02; B65D 21/0201; B65D 21/0204; B65D 21/0209; B65D 21/0211; B65D 21/0212; B65D 21/0213; B65D 21/0215; B65D 21/0219; B65D 21/022; B65D 21/0224; B65D 21/0228; B65D 21/023; B65D 21/0233; B65D 21/0235; B65D 21/045; B65D 21/046; B65D 21/06; B65D 21/062; B65D 21/066; B65D 21/068; B65D 21/086; B65D 2203/10; B65D 2213/00; B65D 2251/0018; B65D 2251/0093; B65D 2251/02; B65D 2301/20; B65D 25/00; B65D 25/02; B65D 25/04; B65D 25/06; B65D 25/10; B65D 25/101; B65D 25/102; B65D 25/106; B65D 25/107; B65D 25/14; B65D 25/20; B65D 25/205; B65D 25/22; B65D 25/24; B65D 25/2811; B65D 25/282; B65D 25/34; B65D 25/38; B65D 25/52; B65D 2501/0081; B65D 2501/24184; B65D 2519/00019; B65D 2519/00024; B65D 2519/00029; B65D 2519/00034; B65D 2519/00059; B65D 2519/00064; B65D 2519/00069; B65D 2519/00129; B65D 2519/00139; B65D 2519/00164; B65D 2519/00169; B65D 2519/00174; B65D 2519/00208; B65D 2519/00233; B65D 2519/00268; B65D 2519/00273; B65D 2519/00288; B65D 2519/00293; B65D 2519/00303; B65D 2519/00318; B65D 2519/00323; B65D 2519/00333; B65D 2519/00338; B65D 2519/00383; B65D 2519/00407; B65D 2519/00422; B65D 2519/00432; B65D 2519/00437; B65D 2519/00442; B65D 2519/00452; B65D 2519/00497; B65D 2519/00502; B65D 2519/00512; B65D 2519/00532; B65D 2519/00562; B65D 2519/00567; B65D 2519/00587; B65D 2519/00601; B65D 2519/00611; B65D 2519/00621; B65D 2519/00631; B65D 2519/00641; B65D 2519/00656; B65D 2519/00661; B65D 2519/00671; B65D 2519/00676; B65D 2519/00711; B65D 2519/00776; B65D 2519/00781; B65D 2519/00786; B65D 2519/00796; B65D 2519/008; B65D 2519/00805; B65D 2519/0081; B65D 2519/00815; B65D 2519/0082; B65D 2519/0086; B65D 2519/00865; B65D 2519/009; B65D 2519/00925; B65D 2519/00955; B65D 2519/0096; B65D 2519/0097; B65D 2519/00995; B65D 2571/00018; B65D 2571/00246; B65D 2575/586; B65D 2581/057; B65D 2583/082; B65D 2585/6867; B65D 2585/6882; B65D 2585/6887; B65D 2585/88; B65D 27/06; B65D 3/04; B65D 31/02; B65D 33/00; B65D 33/001; B65D 33/04; B65D 33/1608; B65D 33/165; B65D 33/20; B65D 43/0256; B65D 43/162; B65D 43/163; B65D 43/26; B65D 47/122; B65D 5/005; B65D 5/321; B65D 5/324; B65D 5/4212; B65D 5/441; B65D 5/445; B65D 5/448; B65D 5/46; B65D 5/4608; B65D 5/50; B65D 5/5028; B65D 5/5405; B65D 5/64; B65D 51/1683; B65D 51/20; B65D 51/243; B65D 53/00; B65D 53/04; B65D 55/028; B65D 59/02; B65D 59/06; B65D 61/00; B65D 65/40; B65D 65/466; B65D 67/00; B65D 67/02; B65D 7/06; B65D 7/14; B65D 7/20; B65D 7/24; B65D 7/44; B65D 71/00; B65D 71/0088; B65D 71/0096; B65D 71/06; B65D 71/50; B65D 71/70; B65D 75/26; B65D 75/30; B65D 75/32; B65D 75/324; B65D 75/566; B65D 75/58; B65D 75/5883; B65D 77/04; B65D 77/0466; B65D 77/06; B65D 77/2032; B65D 77/22; B65D 81/02; B65D 81/05; B65D 81/051; B65D 81/052; B65D 81/07; B65D 81/2038; B65D 81/26; B65D 81/261; B65D 81/263; B65D 81/34; B65D 81/3813; B65D 81/3874; B65D 83/0409; B65D 83/08; B65D 83/0805; B65D 83/0894; B65D 83/768; B65D 85/00; B65D 85/02; B65D 85/04; B65D 85/06; B65D 85/07; B65D 85/18; B65D 85/20; B65D 85/30; B65D 85/34; B65D 85/36; B65D 85/44; B65D 85/46; B65D 85/48; B65D 85/50; B65D 85/58; B65D 85/62; B65D 85/672; B65D 85/68; B65D 85/70; B65D 85/72; B65D 85/80; B65D 88/00; B65D 88/005; B65D 88/022; B65D 88/121; B65D 88/123; B65D 88/127; B65D 88/128; B65D 88/129; B65D 88/16; B65D 88/1631; B65D 88/52; B65D 88/522; B65D 88/524; B65D 88/528; B65D 88/54; B65D 88/546; B65D 88/66; B65D 88/68; B65D 88/703; B65D 88/745; B65D 9/06; B65D 9/10; B65D 9/12; B65D 9/32; B65D 9/34; B65D 90/00; B65D 90/0006; B65D 90/0013; B65D 90/0026; B65D 90/008; B65D 90/021; B65D 90/08; B65D 90/64; B65D 90/66; B66F 11/04; B66F 13/00; B66F 17/003; B66F 2700/09; B66F 3/12; B66F 3/22; B66F 3/245; B66F 7/00; B66F 7/02; B66F 7/06; B66F 7/0625; B66F 7/0641; B66F 7/065; B66F 7/0658; B66F 7/08; B66F 7/14; B66F 7/16; B66F 7/18; B66F 7/22; B66F 7/28; B66F 9/00; B66F 9/02; B66F 9/06; B66F 9/061; B66F 9/07; B66F 9/072; B66F 9/075; B66F 9/07504; B66F 9/07509; B66F 9/07536; B66F 9/0755; B66F 9/07554; B66F 9/07568; B66F 9/07572; B66F 9/07586; B66F 9/0759; B66F 9/08; B66F 9/082; B66F 9/085; B66F 9/10; B66F 9/12; B66F 9/122; B66F 9/141; B66F 9/148; B66F 9/149; B66F 9/16; B66F 9/18; B66F 9/183; B66F 9/184; B66F 9/19; B66F 9/195; B66F 9/20; B66F 9/205; B66F 9/22; B66F 9/24; D03D 29/00; D03D 41/00; D03D 49/00; D03D 51/20; E05Y 2900/132; E05Y 2900/531; E05Y 2900/536; E05Y 2999/00; Y10T 137/1789; Y10T 137/7779; Y10T 137/7849; Y10T 137/7873; Y10T 137/87837; Y10T 137/87877; Y10T 156/10; Y10T 156/1051; Y10T 156/1052; Y10T 156/1056; Y10T 156/1059; Y10T 156/1062; Y10T 156/1067; Y10T 156/1074; Y10T 156/1075; Y10T 156/1089; Y10T 156/1137; Y10T 156/12; Y10T 156/13; Y10T 156/1322; Y10T 156/1348; Y10T 156/1374; Y10T 156/17; Y10T 156/1749; Y10T 156/1761; Y10T 156/1768; Y10T 156/1778; Y10T 156/1939; Y10T 24/2149; Y10T 29/49002; Y10T 29/49009; Y10T 29/49012; Y10T 29/49014; Y10T 29/49071; Y10T 29/49073; Y10T 29/49078; Y10T 29/49108; Y10T 29/49117; Y10T 29/49126; Y10T 29/49337; Y10T 29/4935; Y10T 29/49357; Y10T 29/49366; Y10T 29/4938; Y10T 29/49547; Y10T 29/49556; Y10T 29/4956; Y10T 29/49563; Y10T 29/49604; Y10T 29/49609; Y10T 29/49632; Y10T 29/49787; Y10T 29/4979; Y10T 29/49798; Y10T 29/49801; Y10T 29/4984; Y10T 29/49876; Y10T 29/49902; Y10T 29/49945; Y10T 29/49982; Y10T 29/53113; Y10T 29/53143; Y10T 29/53191; Y10T 29/532; Y10T 407/14; Y10T 407/2212; Y10T 408/95; Y10T 409/309464; Y10T 428/12007; Y10T 428/12153; Y10T 428/12174; Y10T 428/12472; Y10T 428/12479; Y10T 428/192; Y10T 428/21; Y10T 428/24; Y10T 428/24058; Y10T 428/24132; Y10T 428/24149; Y10T 428/24331; Y10T 428/24355; Y10T 428/24479; Y10T 428/2457; Y10T 428/2462; Y10T 428/24744; Y10T 428/249927; Y10T 428/2913; Y10T 428/2973; Y10T 428/30; Y10T 428/31989; Y10T 70/402; Y10T 70/409; Y10T 70/483; Y10T 70/491; Y10T 82/2502; Y10T 82/2512; Y10T 82/2583; Y10T 83/2031; Y10T 83/2037; Y10T 83/2048; Y10T 83/205; Y10T 83/2055; Y10T 83/2059; Y10T 83/2061; Y10T 83/217; Y10T 83/2194; Y10T 83/2198; Y10T 83/4549; Y10T 83/4632; Y10T 83/464; Y10T 83/6656; Y10T 83/739; Y10T 83/783; Y10T 83/8752

USPC ..... 43/1, 107, 110, 113, 116, 122, 131, 43/132.1, 134, 139, 18.5, 25, 3, 4, 41, 42, 43/42.04, 42.09, 42.16, 42.24, 42.26, 43/42.28, 42.31, 42.32, 42.36, 42.37, 43/42.39, 42.49, 42.53, 43.1, 43.11, 43/43.12, 43.13, 43.16, 44.88, 44.91, 43/44.99, 54.1, 55, 57.3, 7, 9.8; 53/212, 53/236, 248, 252, 258, 282, 296, 329.4, 53/430, 439, 442, 447, 473, 474, 475, 53/495, 500, 501, 507, 508, 516, 529, 53/530, 532, 535, 537, 540, 542, 570; 206/5, 7, 213.1, 216, 219, 223, 225, 226, 206/227, 229, 278, 3, 303, 304, 314, 206/315.1, 315.2, 315.4, 315.5, 315.9, 206/320, 362.1, 362.3, 363, 37, 37.2, 206/37.4, 370, 373, 38.1, 386, 388, 389, 206/390, 391, 395, 397, 407, 409, 410, 206/417, 423, 438, 457, 459.5, 463, 464, 206/466, 49, 490, 497, 499, 501, 503, 206/505, 506, 507, 508, 509, 511, 512, 206/513, 519, 521.15, 522, 523, 524.3, 206/524.5, 525, 526, 562, 563, 564, 575, 206/577, 579, 586, 718, 728, 803, 804, 206/805, 811, 820, 822, 824, 83.5; 211/14; 224/919, 922; 242/384.7, 385.4, 242/386, 416, 432.5, 438, 447, 448, 564, 242/570, 571, 592; 446/1, 100, 103, 104, 446/107, 108, 117, 119, 120, 121, 122, 446/124, 126, 128, 129, 131, 133, 135, 446/138, 146, 149, 15, 153, 158, 161, 446/168, 169, 170, 171, 173, 179, 186, 446/19, 190, 193, 195, 213, 215, 216, 446/217, 219, 22, 220, 222, 224, 226, 446/227, 228, 230, 233, 235, 236, 239, 446/242, 243, 245, 246, 247, 248, 249, 446/250, 251, 253, 254, 255, 256, 258, 446/259, 261, 263, 265, 266, 268, 269, 446/27, 270, 28, 287, 3, 30, 304, 305, 446/308, 309, 310, 311, 314, 315, 325, 446/326, 327, 330, 333, 336, 338, 34, 446/343, 345, 351, 352, 353, 354, 355, 446/359, 361, 363, 366, 374, 376, 377, 446/379, 380, 382, 390, 394, 400, 404, 446/408, 409, 412, 415, 419, 42, 421, 446/422, 429, 443, 450, 451, 454, 456, 446/457, 458, 46, 460, 465, 473, 475, 446/476, 484, 486, 489, 490, 491, 51, 53, 446/73, 75, 79; 463/1, 16, 17, 18, 19, 2, 463/20, 22, 23, 25, 29, 3, 30, 31, 32, 33, 463/34, 35, 36, 37, 38, 39, 4, 40, 42, 43, 463/47, 47.1, 47.5, 49, 5, 51, 53, 58, 64, 463/66, 7, 9; 482/1, 109, 11, 110, 112, 482/121, 122, 126, 129, 131, 139, 140, 482/142, 148, 24, 35, 44, 46, 49, 53, 56, 482/57, 63, 7, 71, 74, 78, 79, 8, 81, 83, 482/84, 86, 87, 88, 89, 9, 90, 901, 906, 482/908, 92, 93

See application file for complete search history.

(56) References Cited

U.S. PATENT DOCUMENTS

2004/0033848 A1* 2/2004 Bragg ..... A63B 69/0084 473/423
2015/0068467 A1* 3/2015 Chirico ..... A01K 15/025 119/707
2016/0090228 A1* 3/2016 Soria ..... A47K 10/38 206/233
2018/0264343 A1* 9/2018 Watanabe ..... G06C 1/00

* cited by examiner

DEVICE TO RELEASABLY SECURE PICKLEBALLS

The present disclosure is a nonprovisional of and claims priority to U.S. Provisional Application No. 63/447,331 filed on Feb. 21, 2023 and entitled "Device to Releasably Secure Pickleballs", which is incorporated herein by reference in its entirety.

FIELD

The present disclosure is generally related to holders for securing balls with holes, such as whiffle balls, pickleballs, and the like, and more particularly to a device for releasably securing one or more pickleballs.

BACKGROUND

Pickleball is an indoor or outdoor racket/paddle sport where two players (singles) or four players (doubles) hit a hollow polymer ball with a plurality of holes back and forth over a net using solid-faced paddles or racquets. The pickleball court is less than a third of the size of a tennis court, and consequently pickleball courts are often closely arranged on a basketball court (indoors) or on a tennis court (indoors or outdoors).

SUMMARY

Embodiments of a pickleball holder are described below that may be configured to secure one or more pickleballs for temporary storage and to allow a user to remove one or more pickleballs from the pickleball holder as needed. The pickleball holder may include a shaft with a spring-loaded latch or spring arm configured to retract as a pickleball is pushed or pulled over the latch and to extend to prevent the pickleball from sliding off the shaft. The spring-loaded latch or spring arm may be positioned at least partially within the shaft and may compress into the shaft in response to pressure from the holes of a pickleball. The pickleball holder may be configured to hang on a fence or a net and to secure one or more pickleballs.

In one or more embodiments, the pickleball holder may include a shaft with a first end and a second end. The pickleball holder may include a spring mechanism integrated within the shaft near the first end and may include a hook, a cord, a string, another element, or any combination thereof coupled to the second end. In some embodiments, the pickleball holder may include a cord including a first end coupled to the second end of the shaft and including a second end coupled to a hook, a carabiner, or another fastener, which may be releasably attached to a fence, a net, or another structure, or to a portable device, such as a backpack, a duffle bag, a vehicle handle, a bicycle, and so on. The shaft may be pushed through a hole in a pickleball, and the pickleball may be moved over the spring mechanism to secure the pickleball on the pickleball holder. In some implementations, the user may secure multiple pickleballs to the pickleball holder by advancing multiple pickleballs over the spring mechanism and onto the cord.

A user may add a ball to the pickleball holder by pushing the shaft through the pickleball and may retrieve a ball from the pickleball holder by pulling a pickleball off the shaft. The user may hang the pickleball holder on the net, a nearby fence, or another structure for ease of storage and retrieval. When packing up to leave, the user may unhook the pickleball holder and carry it with him or her and optionally may couple the pickleball holder to a portable device, such as a backpack, a duffle bag, a vehicle handle, a bicycle, and so on.

In an example, a user may push the shaft through a first hole in a pickleball that has a plurality of holes. The user may advance the shaft through the pickleball and out through a second opening on an opposing side of the pickleball. As the spring mechanism near the first end of the shaft is pushed through the first hole, the sidewall of the hole may compress the spring mechanism. Once the spring mechanism passes through the first hole, the spring mechanism may expand, securing the pickleball. As the shaft is pushed through the second opening, the sidewall of the second hole compresses the spring mechanism and, after the spring mechanism exits the second hole, the spring mechanism may expand, securing the pickleball and allowing room for the user to attach one or more additional pickleballs to the shaft and associated cord. The shaft may be pushed through multiple pickleballs, which may slide over the shaft and onto and along the cord. The spring mechanism may prevent the pickleballs from falling off the pickleball holder.

In some implementations, a pickleball holder may include a shaft having a diameter sized to fit through one or more holes in a pickleball and a cord coupled to an end of the shaft. The pickleball holder may include a spring mechanism coupled to the shaft and configured to compress as the spring mechanism passes through a hole and to expand to secure the pickleball when the spring mechanism is outside of the hole to releasably secure one or more pickleballs.

In other implementations, a pickleball holder may include a shaft having a diameter sized to fit through one or more holes in a pickleball and having a length of five inches or more, which is greater than a diameter of a pickleball so that the shaft can be pushed through the entire width of the pickleball. The shaft may include a first end and a second end. The pickleball holder may include a cap coupled to the first end of the shaft and an attachment mechanism coupled to the send end of the shaft. In some embodiments, the attachment mechanism may include a plug with a loop or hook that can be connected to the second end of the shaft. The hook or loop may be used to attach a cord (e.g., a rope, a string, a wire, or other thin and flexible material), a carabiner, a hook, another component, or any combination thereof.

In some embodiments, the pickleball holder may include a cord including a first end and a second end. The first end may be coupled to the plug and the second end may be coupled to or may include a releasable attachment mechanism configured to releasably couple to one or more of a net, a fence, or a structure, or to a portable device, such as a backpack, a duffle bag, a vehicle handle, a bicycle, and so on. The shaft may include a spring mechanism configured to compress as the spring mechanism passes through a hole of the one or more holes and to expand when the spring mechanism is outside of the hole to releasably secure one or more pickleballs. In some embodiments, the spring mechanism may include a spring configured to compress and expand in response to pressure applied by the internal diameter of the hole of the pickleball.

In still other implementations, a pickleball holder may include a shaft formed from a hollow tube. The shaft may include a first end and a second end. The shaft may have a diameter sized to fit through one or more holes in a pickleball and may have a length of selected to be longer than a diameter of a pickleball. In some embodiments, the length of the shaft may be five inches (5 in) or more. The pickleball holder may include a spring mechanism coupled to or integrated with the shaft near the first end. The spring mechanism may be configured to compress into the shaft in response to pressure and to expand when the pressure is removed to secure one or more pickleballs. The pickleball holder may include an attachment device coupled to the second end of the shaft. The attachment mechanism may be configured to releasably couple the pickleball holder to a structure, a backpack, a duffle bag, a vehicle, another device, or any combination thereof.

BRIEF DESCRIPTION OF THE DRAWINGS

The detailed description is set forth with reference to the accompanying figures. In the figures, the left most digit(s) of a reference number identifies the figure in which the reference number first appears. The use of the same reference numbers in different figures indicates similar or identical items or features.

Figure 1:
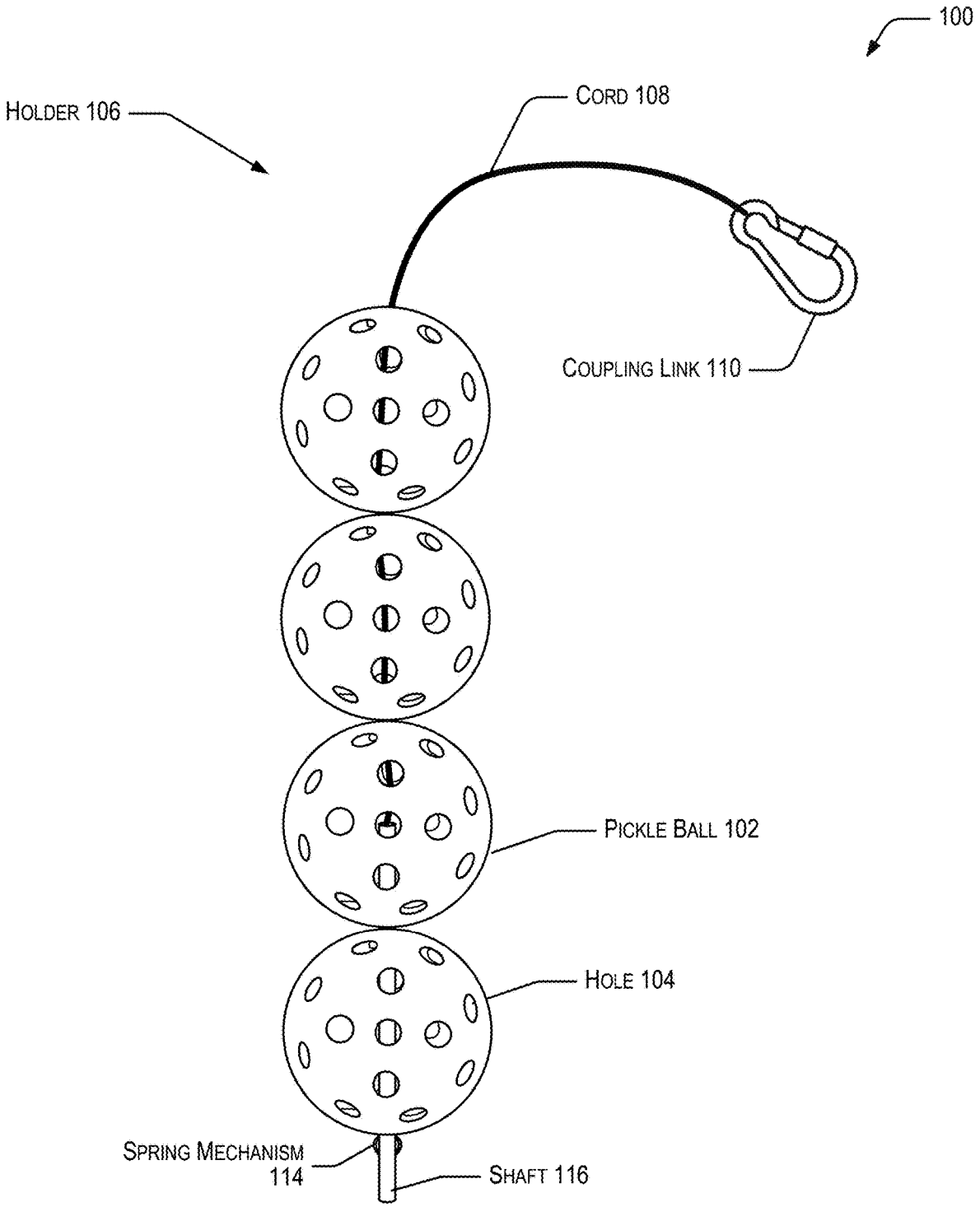
FIG. 1 depicts a diagram of an apparatus configured to secure one or more pickleballs, in accordance with certain embodiments of the present disclosure.

While implementations are described in this disclosure by way of example, those skilled in the art will recognize that the implementations are not limited to the examples or figures described. The figures and detailed description thereto are not intended to limit implementations to the particular form disclosed, but on the contrary, the intention is to cover all modifications, equivalents, and alternatives falling within the spirit and scope as defined by the appended claims. The headings used in this disclosure are for organizational purposes only and are not meant to limit the scope of the description or the claims. As used throughout this application, the word "may" is used in a permissive sense (in other words, the term "may" is intended to mean "having the potential to") instead of in a mandatory sense (as in "must"). Similarly, the terms "include," "including," and "includes" mean "including, but not limited to."

DETAILED DESCRIPTION OF ILLUSTRATIVE EMBODIMENTS

Embodiments of a pickleball holder are described below that may be configured to releasably secure one or more pickleballs. The pickleball holder may include a shaft with first end and a second end. The shaft may include a spring mechanism near the first end and may include an attachment mechanism coupled to the second end. The attachment mechanism may include a loop, a hook, a cord (e.g., a string, a rope, a wire, a chain, or other thin and flexible material), a carabiner, or any combination thereof. In some embodiments, the attachment mechanism may be configured to releasably couple the shaft to a fence, a net, or another structure, or to a portable device, such as a backpack, a duffle bag, a vehicle handle, a bicycle, and so on. The spring mechanism and the attachment mechanism may cooperate to secure the pickleballs. The shaft may be pushed through one or more pickleballs, and the pickleballs may be pushed off the shaft and onto the cord.

In some implementations, the pickleball holder may include a shaft including a first end and including a second end. The second end may be coupled by a cord to a hook, a carabiner, or another attachment device to enable releasable attachment to a fence, a net, or another structure, or to a portable device, such as a backpack, a duffle bag, a vehicle handle, a bicycle, and so on. The first end of the shaft may include a spring mechanism configured to releasably secure one or more pickleballs. In some implementations, the spring mechanism may be formed from a wire configured to form a spring that fits through slots in the shaft. The spring may be compressed by the interior surface of a hole of the pickleball as the user pushes or pulls the pickleball over spring and the spring may expand when the spring moves past the interior surface of the hole. In other implementations, the spring mechanism may be formed by a pair arms coupled by a hinge on a first end and biased toward one another by a spring on a second end. The spring mechanism may have sufficient strength to hold multiple pickleballs and may be flexible enough to allow a user to push and pull pickleballs over the spring mechanism.

In some implementations, the pickleball holder may include a shaft, which may be formed from one or more of plastic, carbon fiber, steel, aluminum, polyvinyl chloride (PVC), fiberglass, steel, or other material. In some implementations, the shaft may be a hollow tube with one or more slots cut near one end. In some implementations, a pair of slots may be cut on opposite sides of the shaft. A spring latch may be pushed into the shaft and a portion of the spring latch may extend through the one or more slots. The spring mechanism may be configured to compress as the shaft is pushed through a hole in a pickleball and to expand when the shaft exits the hole, securing the pickleball to the shaft or to an associated cord. An example of a pickleball holder is shown and described with respect to FIG. 1.

FIG. 1 depicts a diagram of an apparatus 100 configured to secure one or more pickleballs 102, in accordance with certain embodiments of the present disclosure. Each pickleball 102 is hollow and includes a plurality of openings or holes 104 that extend through its surface. Depending on the implementation, the diameters of the holes 104 may be the same or may vary. The pickleball 102 is formed from a rigid plastic material, and is designed to be struck by a pickleball paddle or racquet.

Pickleball games are played on pickleball courts, which are often adapted from basketball courts, tennis courts, or other existing courts. Pickleball courts are often positioned close to one another such that mishit pickleballs may enter adjacent courts. Recovering pickleballs and keeping track of spare pickleballs can interfere with enjoyment of and extend the time of the game.

The apparatus 100 includes a pickleball holder 106 that can make it easier to secure and keep track of spare pickleballs 102 during the game and to store pickleballs 102 during transit and storage. The pickleball holder 106 may include a shaft 116 coupled to a cord 108, which may be coupled to a coupling link 110, such as a hook, a carabiner, another attachment mechanism, or any combination thereof. The cord 108 may include two strands including two ends of the same cord 108. The cord 108 may be implemented as a string, a shoelace, a rope, a ribbon, a wire, or other flexible line or material formed from strands of fibers twisted together. The coupling link 110 may be used to releasably couple the pickleball holder 106 to a net, a fence, or another structure, or to a portable device, such as a backpack, a duffle bag, a vehicle handle, a bicycle, and so on.

The shaft 116 may have a diameter that is smaller than the diameter of at least some of the holes 104 of a pickleball 102. In some implementations, the diameter may be smaller than approximately 0.25 inches. Additionally, the shaft 116 may have a length that is greater than the diameter of a pickleball 102. In some implementations, the shaft 116 may have a length that is five inches or greater, allowing room for a user to grip the shaft 116 while pushing the shaft 116 through a first hole 104 on one side of the pickleball 102 and a second hole 104 on an opposite side of the pickleball 102.

The shaft 116 may include a first end and a second end. The second end may be coupled to the cord 108 (or to another attachment mechanism). The shaft 116 may include a spring mechanism 114 near the first end. The spring mechanism 114 may be configured to compress to fit through one or more holes 104 in the pickleballs 102 and otherwise to be expanded to prevent the pickleballs 102 from sliding off the end of the shaft 116.

In some implementations, the spring mechanism 114 may be formed from a wire spring shaped to provide a spring-loaded latch. In other implementations, the spring mechanism 114 may be formed from a pair of arms biased by a spring to extend to provide a spring-loaded latch. The spring mechanism 114 may be configured to compress in response to application of a force that is greater than a threshold force and to expand when the force is removed. The threshold force to compress the spring mechanism 114 may be greater than a combined weight of a selected number of pickleballs 102. In an example, the spring mechanism 114 may be configured to support the combined weight of more than a dozen pickleballs 102. In some embodiments, the spring may be compressed by a threshold force that is approximately one pound (1 lb.). In other embodiments, the spring may be compressed by a threshold force that is greater than or less than one pound (1 lb.).

Figure 2A:
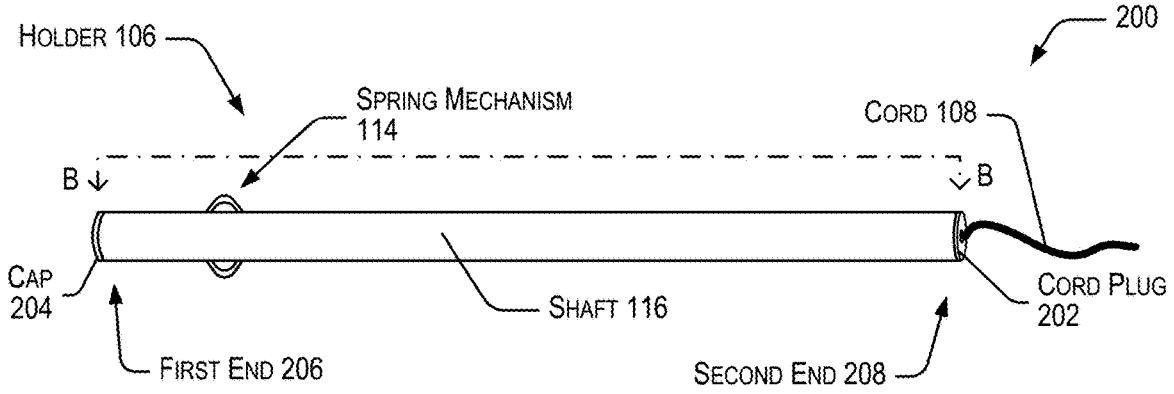
FIG. 2A depicts a side view of a portion of the apparatus of FIG. 1, in accordance with certain embodiments of the present disclosure.

FIG. 2A depicts a side view of a portion 200 of the apparatus 100 of FIG. 1, in accordance with certain embodiments of the present disclosure. The portion 200 may include the shaft 116 with the spring mechanism 114. The shaft 116 may be formed from a hollow tube. The hollow tube may be formed from one or more of plastic, carbon fiber, steel, aluminum, polyvinyl chloride (PVC), or fiberglass. In some implementations, a pair of openings may be cut on opposite sides of the shaft 116.

The shaft 116 may include a first end 206 and a second end 208. The spring mechanism 114 may be disposed near the first end 206 of the shaft 116. A cap 204 may seal the first end 206 of the shaft 116. The second end 208 of the shaft 116 may be sealed by a cord plug 202. One or more of the cap 204 or the cord plug 202 may be press-fitted, glued, welded, screwed, or otherwise fixed to one of the first end 206 or the second end 208 of the shaft 116. The cord plug 202 may fit within the second end 208 of the shaft 116 and may include or be coupled to the cord 108 (a string, a shoelace, a rope, a ribbon, a wire, or other flexible line formed from strands of fibers twisted together). It should be understood that the other end of the cord 108 may be coupled to the coupling link 110. While only one cord 108 is shown extending from the cord plug 202, in some implementations, the cord plug 202 may include a pair of cords 108 or two ends of the same cord 108.

Figure 2B:
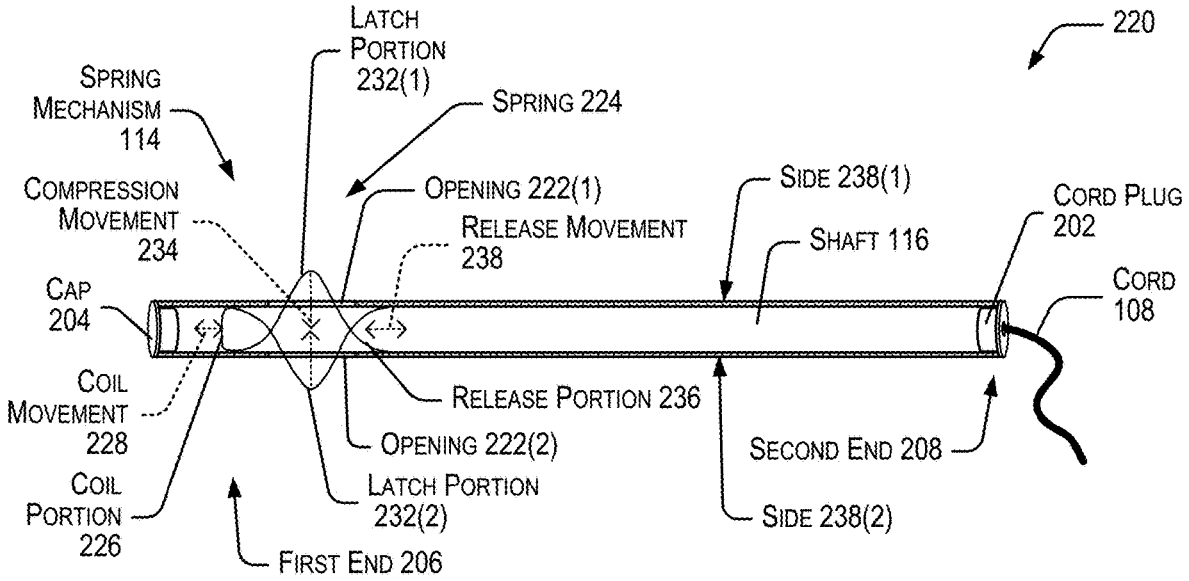
FIG. 2B depicts a cross-sectional view of the portion of the apparatus of FIG. 2A, in accordance with certain embodiments of the present disclosure.

FIG. 2B depicts a cross-sectional view 220 of the portion 200 of the apparatus 100 taken along line B-B in FIG. 2A, in accordance with certain embodiments of the present disclosure. The cross-sectional view 220 depicts the hollow center of the shaft 116. The second end 208 of the shaft 116 may include a cord plug 202, which may couple the cord 108 to the shaft 116. A cap 204 may seal the first end 206.

The pickleball holder 106 may include a spring mechanism 114 partially within the shaft 116 near the first end 206. The spring mechanism 114 may be formed from a wire having a selected weight and bent to form a spring 224 defining a spring-loaded latch.

The shaft 116 may be formed from a hollow tube that has a substantially continuous interior surface 238. A first opening 222(1) may extend through a first side 238(1) of the shaft 116, and a second opening 222(2) may extend through a second side 238(2). Portions 232 of the spring 224 may extend through the first and second openings 222.

The spring 224 may be formed from a unitary piece of wire. The wire may be bent into a coil portion 226, a pair of spring portions 232, and a release portion 236. The release portion may extend toward the second end 208, while the coil portion 226 may be near the first end 206. The wire may extend from a first part of the release portion 236 toward the first end 206 to a first latch portion 232 and then to the coil portion 226, which curves back toward the second end 208 to the second latch portion 232 and a second end of the release portion 236.

The wire of the spring 224 includes a first end that is open and that forms a first side of the release portion 236, which contacts the interior surface of the second side 238(2) of the shaft 116. The wire bends upward from the first end and extends through the first opening 222(1) to form a first latch portion 232(1), which extends away from the shaft 116 then bends back toward the shaft 116. The wire extends through the opening 222(1) and contacts the interior surface of the second side 238(2) before bending in a circular shape that contacts the interior surface of the first side 238(1) of the shaft 116, forming the coil portion 226. The wire bends downward through the second opening 222(2) to form a second latch portion 232(2) that extends away from the shaft 116 and that bends back toward the shaft 116. The wire extends through the opening 222(2) and contacts the interior surface of the first side 238(1) forming a second end of the wire and completing the release portion 236.

When pressure is applied to the spring portions 232, the pressure causes the spring portions 232 to compress into the shaft as indicated by the compression movement arrow 234. by a pickleball 102, the latch portion 232 may compress in the direction of compression movement 234 indicated by the dashed arrow, the coil portion 226 may move in the direction of coil movement 228 (toward or away from the first end 206 along the length of the shaft) indicated by the dashed arrow, and the release portion 236 may move in the direction (along the length of the shaft toward or away from the send end 208) of release movement 238 indicated by the dashed arrow. The release portion 236 may allow the ends of the spring 224 to move toward one another to dissipate some of the compressive force.

In this example, the spring 224 may be compressed and pushed through an opening in the first end 206 and aligned to the openings 222 to install the spring 224. Once installed, the cap 204 may be secured to the first end 206. The cord plug 202 may be attached to the second end 208. A proximal end of the cord 108 may be coupled to the cord plug 202 and a distal end of the cord 108 may be coupled to a coupling link 110.

Figure 2C:
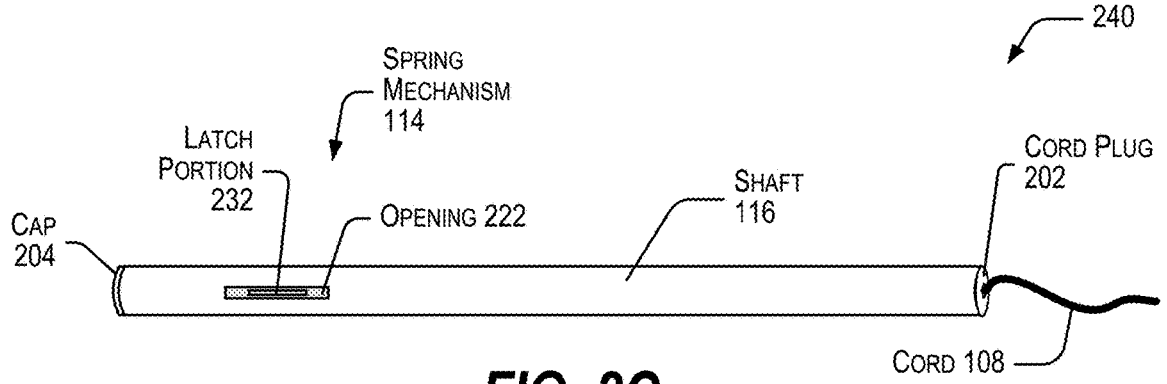
FIG. 2C depicts a top view of the portion of the apparatus of FIG. 2A, in accordance with certain embodiments of the present disclosure.

FIG. 2C depicts a top view 240 of the portion 200 of the apparatus 100 of FIG. 2A, in accordance with certain embodiments of the present disclosure. The shaft 116 includes openings 222, which are aligned on opposite sides of the shaft 116 and which extend through the sidewall of the shaft 116. The latch portion 232 of the spring 224 may extend through the openings 222 to provide the spring mechanism 114 configured to secure one or more pickleballs 102.

In the example of FIGS. 1-2C, the spring mechanism 114 includes a spring 224 formed from a unitary piece of wire that is bent to provide a spring 224 that provides the spring mechanism 114. While the unitary piece of wire that forms the spring 224 may represent an efficient method of providing the spring mechanism 114, the spring mechanism 114 may be implemented in other ways. An alternative implementation is described below with respect to FIG. 3A.

Figure 3A:
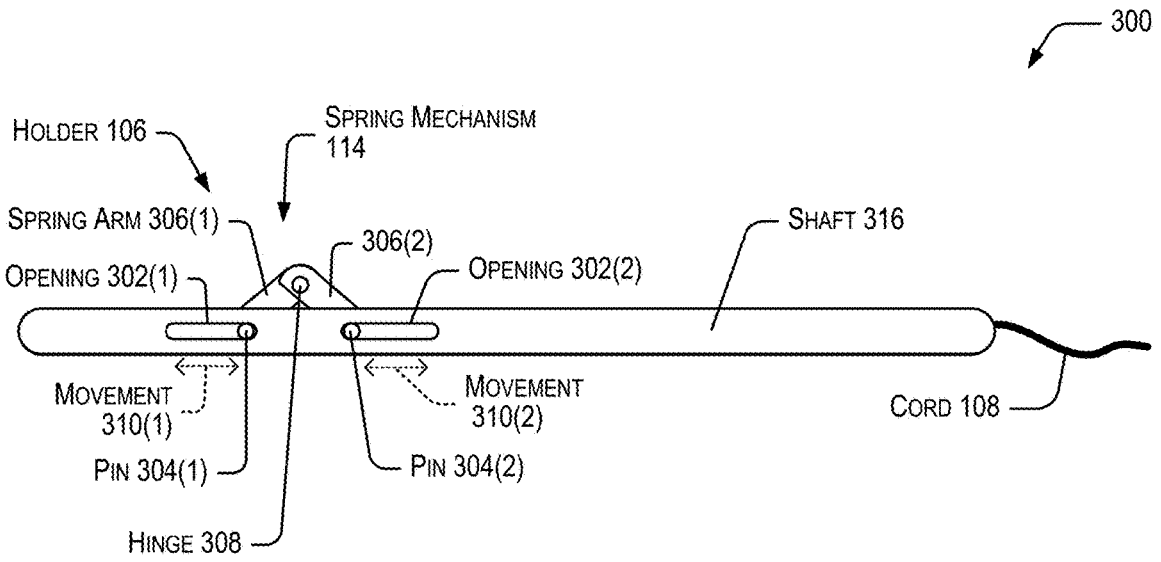
FIG. 3A depicts a side view of a portion of an alternative apparatus configured to secure one or more pickleballs, in accordance with certain embodiments of the present disclosure.

FIG. 3A depicts a side view of a portion of an alternative apparatus 300 configured to secure one or more pickleballs 102, in accordance with certain embodiments of the present disclosure. The apparatus 300 may include a shaft 316, which may have an outside diameter sized to fit through one or more openings in the surface of a pickleball. The shaft 316 may include elongate openings 302(1) and 302(2). The spring mechanism 114 may include a first spring arm 306(1) having a first end and a second end. The first end of the first spring arm 306(1) may be coupled to a first opening 302(1) by a first pin 304(1). The second end of the first spring arm 306(1) may be coupled to a hinge 308. The spring mechanism 114 may include a second spring arm 306(2) having a first end and a second end. The first end of the second spring arm 306(2) may be coupled to a second opening 302(2) by a second pin 304(2). The second end of the second spring arm 306(2) may be coupled to the hinge 308. The first pin 304(1) and the second pin 304(2) may be coupled to one another and spaced apart by a spring. In response to pressure applied to the hinge 308 and the spring arms 306, the pins 304 may move apart, stretching the spring 326 (shown in FIG. 3B). The spring 326 may bias the pins 304 toward one another, causing the spring arms 306 to buckle or pivot about the hinge 308.

In this example, the shaft 316 may be formed from a single tube or from multiple pieces that are coupled together. The shaft 316 may have a diameter that is smaller than the diameter of the holes 104 of a pickleball 102. In some implementations, the diameter may be smaller than approximately 0.25 inches. Additionally, the shaft 116 may have a length that is greater than the diameter of a pickleball 102. In some implementations, the shaft 116 may have a length that is five inches or greater, allowing room for a user to grip the shaft 116 while pushing the shaft 116 through the pickleball 102.

Figure 3B:
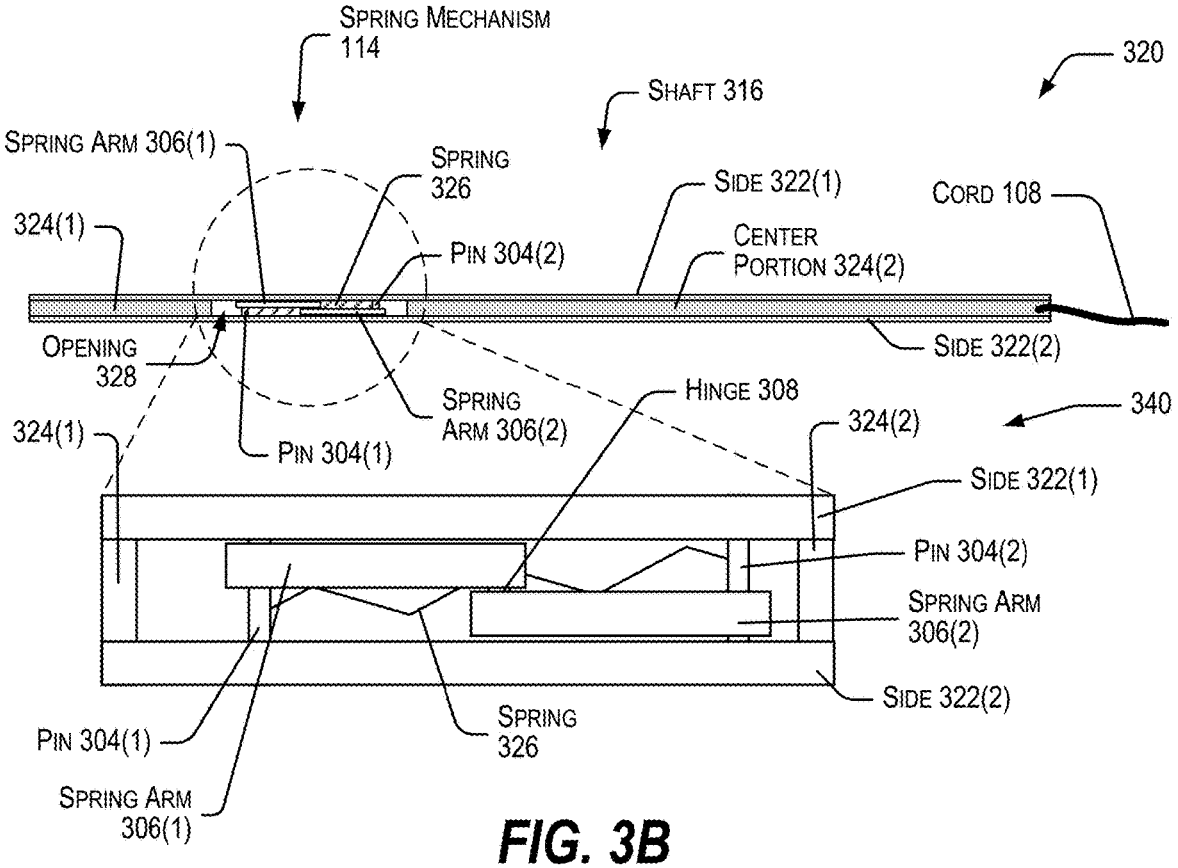
FIG. 3B depicts a top view of the portion of the apparatus and an expanded view of a spring mechanism to secure one or more pickleballs, in accordance with certain embodiments of the present disclosure.

In the illustrated example, the shaft 316 may be formed from two sides and a center layer or portion (shown in FIG. 3B). The cord 108 may be coupled to or integrated with the center layer or portion on one end and may be coupled to the coupling link 110 on the other end.

FIG. 3B depicts a top view 320 of the portion of the apparatus 300 and an expanded view of a spring mechanism 114 to secure one or more pickleballs, in accordance with certain embodiments of the present disclosure. The shaft 316 may be comprised of a first side 322(1), a second side 322(2), and center portions 324(1) and 324(2). There may be a gap or opening 328 between the center portions 324(1) and 324(2) to allow room for the spring mechanism 114. A first end of the cord 108 may be coupled to or integrated with the center portion 324(2) and a second end of the cord 108 may be coupled to the coupling link 110.

In the illustrated example, the spring arms 306(1) and 306(2) are coupled by pins 304(1) and 304(2), respectively, by extending through openings 302 through the sides 322. The spring mechanism 114 may include a spring 326 extending between the pins 304(1) and 304(2) to bias the pins 302 (and the associated ends of the spring arms 306 toward one another.

A first end of each of the spring arms 306 is coupled by a pin 304 to one or more of the openings 302(1) or 302(2). The second end of the spring arms 306 may be coupled by a hinge or pin 308. A spring 326 may be coupled to each of the pins 304 to bias the pins 304 toward one another. In a retracted state, the spring arms 306 may extend beyond a peripheral edge of the shaft 316 to provide a lock or latch to receive and secure one or more pickleballs 102.

Figure 4:
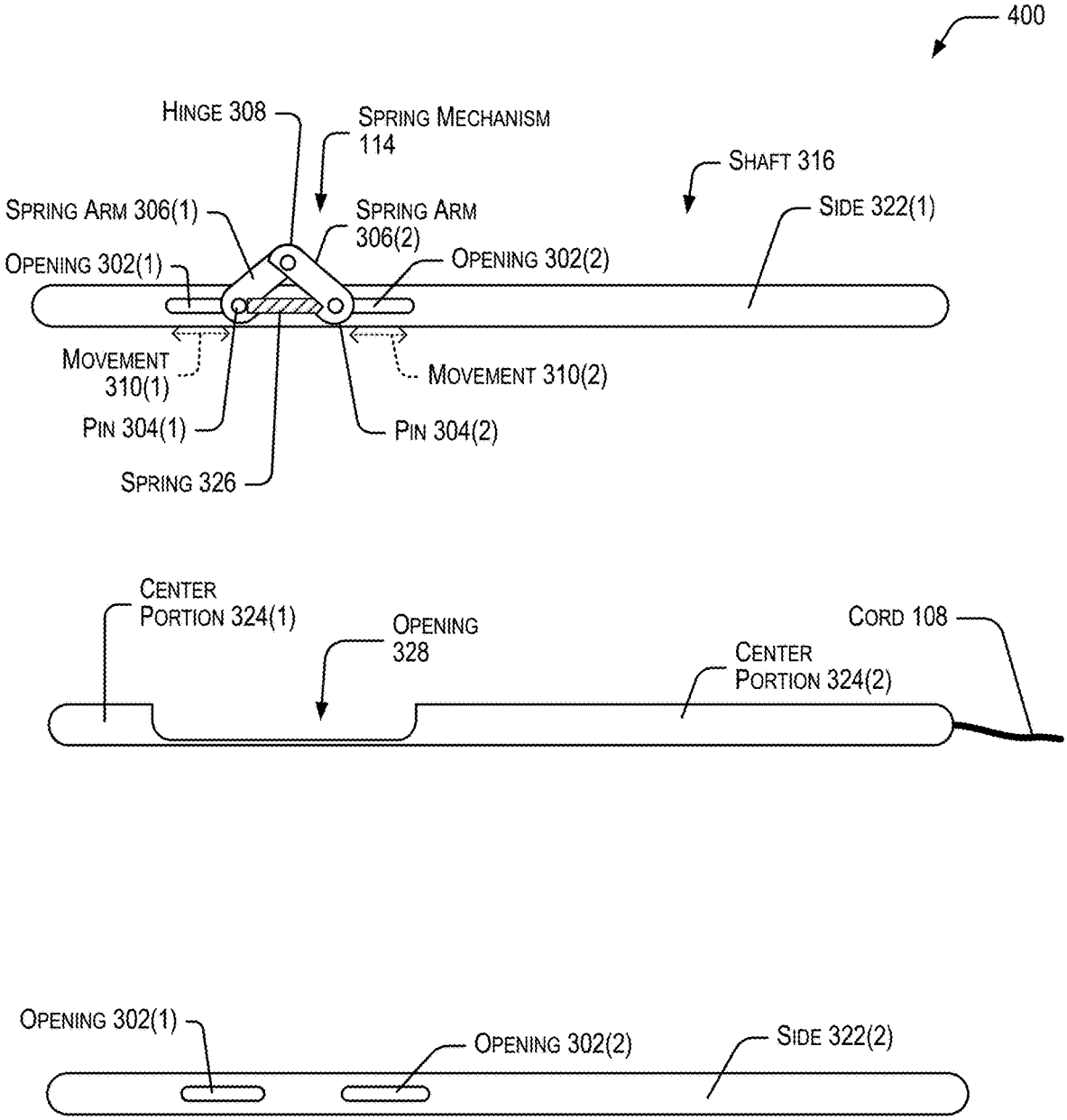
FIG. 4 depicts an exploded view of the portion of the apparatus of FIG. 3A including the spring mechanism, in accordance with certain embodiments of the present disclosure.

FIG. 4 depicts an exploded view 400 of the portion of the apparatus 300 of FIG. 3A including the spring mechanism 114, in accordance with certain embodiments of the present disclosure. In this example, the side 322(1) is shown and is separated from the center portions 324 and from the side 322(2). Each of the sides 322(1) and 322(2) have openings 302(1) and 302(2) that are aligned and sized to receive pins 304.

The center portions 324(1) and 324(2) are separated by a gap or opening 328 sized to expose the openings 302 and to host the spring mechanism 114. The cord 108 may include a first (proximal) end coupled to or integrated with the center portion 324(2) and a second (distal) end coupled to the coupling link 110.

In this example, the spring mechanism 114 may include a first spring arm 306(1) including a first end that is coupled to the first opening 302(1) by a first pin 304(1) and including a second end coupled to a hinge 308. The spring mechanism 114 may include a second spring arm 306(2) including a first end coupled to the second opening 302(2) by a second pin 304(2) and including a second end coupled to the hinge 308. The spring 326 may bias the first ends of the spring arms 306 toward one another.

Figure 5A:
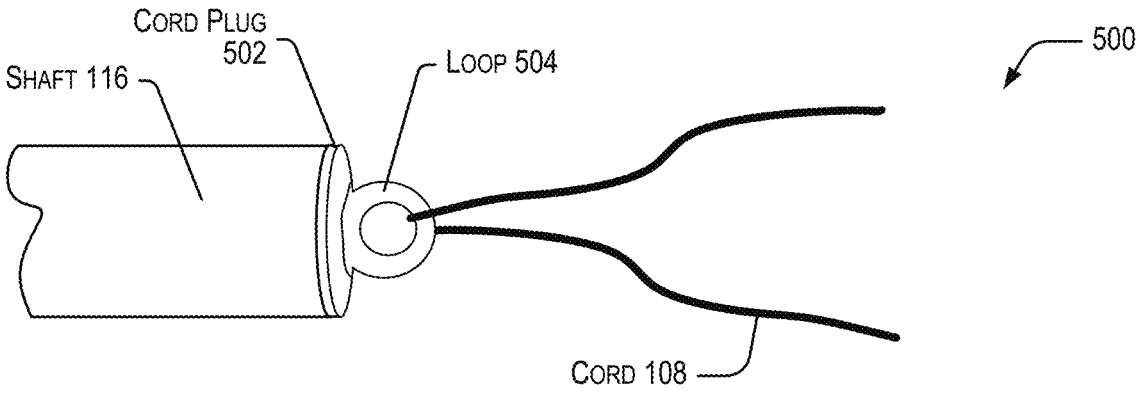
FIG. 5A depicts a side view of a portion of the apparatus of FIG. 2A including an alternative cord attachment, in accordance with certain embodiments of the present disclosure.

FIG. 5A depicts a side view of a portion 500 of the apparatus 200 of FIG. 2A including an alternative cord attachment, in accordance with certain embodiments of the present disclosure. The portion 500 may include a portion of the shaft 116 and a cord plug 502 that includes a loop 504. The cord 108 may extend through the loop 504, and the loop 504 may couple the cord 108 to the shaft 116.

In some implementations, a user may insert a cord 108 (a string, a shoelace, a rope, a ribbon, a wire, or other flexible line formed from strands of fibers twisted together) through the loop 504 and attach the cord 108 to the coupling link 110. The cord plug 502 with the loop 502 may allow the user to select the cord 108.

Figure 5B:
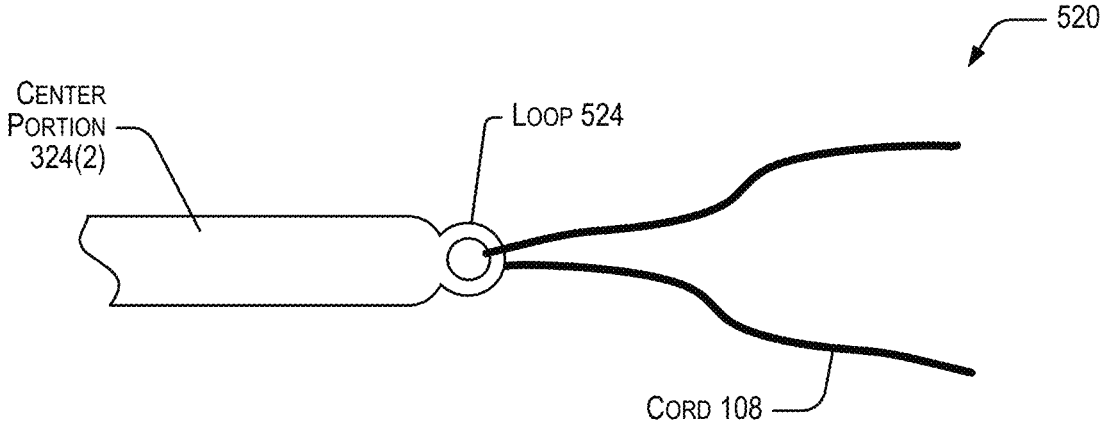
FIG. 5B depicts a side view of a portion of the apparatus of FIGS. 3A and 3B, in accordance with certain embodiments of the present disclosure.

FIG. 5B depicts a side view of a portion 520 of the apparatus 300 of FIGS. 3A and 3B, in accordance with certain embodiments of the present disclosure. In this example, only the center portion 324(2) of the shaft 316 is shown. The center portion 324(2) may have an integrated loop 524 that extends beyond its peripheral edge. A user may insert a cord 108 (a string, a shoelace, a rope, a ribbon, a wire, or other flexible line formed from strands of fibers twisted together) through the loop 524.

Figure 5C:
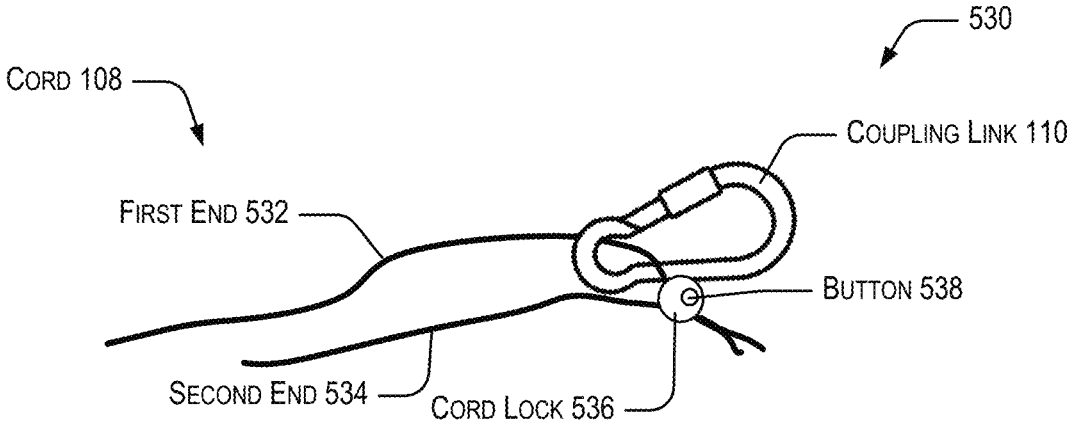
FIG. 5C depicts a side view of a portion of the apparatus of FIG. 1 including the link mechanism and a cord lock, in accordance with certain embodiments of the present disclosure.

FIG. 5C depicts a side view of a portion 530 of the apparatus 100 of FIG. 1 including the link mechanism 110 and a cord lock 536, in accordance with certain embodiments of the present disclosure. In some implementations, it may be desirable to adjust the length of the cord 108. In the illustrated example, the portion includes a cord 108 having a first end 532 and a second end 534. The first end 532 is shown extending through the coupling link 110 and coupled to the second end 534 by an adjustable cord lock 536.

The cord lock 536 may be cylindrical, spherical, or another shape and may include one or more openings to receive the ends of the cord 108. The cord lock 536 includes a button 538 that may allow the user to release the cord lock 536, adjust the amount of cord 108 on either side of the cord lock 536, and then secure the ends 532 and 534. Alternatively, the user may tie a knot to couple the ends 532 and 534 at a selected distance from the shaft 116 or 316.

It should be appreciated that the coupling link 110 is depicted as a carabiner with a threaded lock feature; however, other types of carabiners may also be used. Also, in other implementations, the coupling link 110 may be implemented as a hook, a clasp, a clamp, or another linking mechanism. In still another implementation, the coupling link 110 may be implemented as or replaced by the cord lock 536, which may operate as a coupling link 110 that may be coupled to a net, a fence, or another structure, or to a portable device, such as a backpack, a duffle bag, a vehicle handle, a bicycle, and so on.

In conjunction with the embodiments described above with respect to FIGS. 1-5C, a pickleball holder 106 is disclosed that includes a shaft 116 or 316 including a first end and a second end. The pickleball holder 106 may include a spring mechanism 114 near the first end and may include a cord 108 coupled to the second end. In some implementations, a spring mechanism 110 may be coupled to a distal end of the cord 108 to releasably attach the pickleball holder 106 to a net, a fence, or another structure, or to a portable device, such as a backpack, a duffle bag, a vehicle handle, a bicycle, and so on.

In some implementations, the spring mechanism 114 may be formed by a wire that is bent to form a spring including latch elements. In other implementations, the spring mechanism 114 may be formed by a pair of spring arms 306 that are biased toward one another by a spring 326.

In some implementations, a pickleball holder 106 may include a shaft 116 having a diameter sized to fit through one or more holes 104 in a pickleball 102 and a cord 108 coupled to an end of the shaft 116. The pickleball holder 106 may include a spring mechanism 114 coupled to the shaft 112 and configured to compress as the spring mechanism 112 passes through a hole 104 of the pickleball 102 and to expand when the spring mechanism 114 is outside of the hole 104 to releasably secure one or more pickleballs 102.

In some implementations, the spring mechanism 114 may include a wire bent to form a spring 224 including spring arms 232 and openings 222 formed in the shaft 116 and sized to receive the spring arms 232. The wire may include a coil portion 226, a latch portion 232 comprising one or more ridges, and a release portion 236 comprising an open end. The latch portion 232 is configured to retreat into the shaft 116 in response to pressure and to expand out of the openings 222 in the shaft 116 when the pressure is removed.

In some implementations, the pickleball holder 106 may include a link mechanism 110 coupled to a distal end of the cord 108 and configured to couple to one or more of a net, a fence, or a structure, or to a portable device, such as a backpack, a duffle bag, a vehicle handle, a bicycle, and so on. The link mechanism 110 may include a carabiner, a hook, a latch, a cord lock, a knot, or another attachment mechanism.

In some implementations, the pickleball holder 106 may include a cap 204 coupled to the first end 206 of the shaft 116 and a cord plug 202 coupled to the second end 208 of the shaft 116. The cord plug 202 may be coupled to a proximal end of a cord 108 and a link mechanism 110 may be coupled to a distal end of the cord 108 to couple the pickleball holder 106 to a net, a fence, or a structure or to a portable device, such as a backpack, a duffle bag, a vehicle handle, a bicycle, and so on. The shaft 116 may be formed from one or more of plastic, carbon fiber, steel, aluminum, polyvinyl chloride (PVC), or fiberglass. The shaft 116 may include a hollow tube. The shaft 116 may have a length of five inches or more.

In some implementations, the shaft 116 may include a first sidewall 322(1) including a first opening 302(1) and a second opening 302(2) near the first end 206, a second sidewall 322(2) including a first opening 302(1) and a second opening 302(2) near the first end 206 and aligned with the first opening 302(1) and the second opening 302(2) of the first sidewall 322(1), and a center portion 324 configured to fit between the first sidewall 322(1) and the second sidewall 322(2). The center portion 324 may include an opening 328 that extends from an edge of the center portion 324 and around both the first opening 302(1) and the second opening 302(2). The opening 328 in the center portion may be configured to provide room for the spring mechanism 114 to move around the first and second openings 302. In this implementation, the spring mechanism 114 may include a first spring arm 306(1) including a first end and a second end and a second spring arm 306(2) including a first end and a second end. A first pin 304(1) may be configured to couple the first end of the first spring arm 306(1) to the first openings 302(1) in the first sidewall 322(1) and the second sidewall 322(2). The second pin 304(2) may be configured to couple the first end of the second spring arm 306(2) to the second openings 302(2) in the first sidewall 322(1) and the second sidewall 322(2). A hinge 308 may be configured to couple the second end of the first spring arm 306(1) to the second end of the second spring arm 306(2). A spring 326 may be configured to bias the first pin 304(1) toward the second pin 304(2).

Although the present invention has been described with reference to preferred embodiments, workers skilled in the art will recognize that changes may be made in form and detail without departing from the scope of the invention.

What is claimed is:

1. A pickleball holder comprising:

a shaft comprising a tube and having a diameter sized to fit through one or more holes in a pickleball; and a spring mechanism at least partially within the shaft and configured to compress as the spring mechanism passes through a hole of the one or more holes and to expand when the spring mechanism is outside of the hole to releasably secure one or more pickleballs.

2. The pickleball holder of claim 1, further comprising a cord coupled to an end of the shaft.

3. The pickleball holder of claim 2, wherein the cord comprises a first end coupled to the end of the shaft and a second end, and further comprising:

a link mechanism coupled to the second end of the cord and configured to couple to one or more of a net, a fence, a structure, a backpack, a bag, a bicycle, or a vehicle.

4. The pickleball holder of claim 1, wherein the spring mechanism comprises:

a wire bent to form a spring including spring arms; and openings formed in the shaft and sized to receive the spring arms.

5. The pickleball holder of claim 4, wherein the wire includes:

a coil portion;

a spring portion comprising one or more ridges; and a release portion comprising an open end; and wherein the spring portion is configured to retreat into the shaft in response to pressure and to expand out of the openings in the shaft when the pressure is removed.

6. The pickleball holder of claim 1, further comprising:

a cap coupled to the first end of the shaft; and a plug coupled to the second end of the shaft, the plug configured to be coupled to a cord.

7. The pickleball holder of claim 1, wherein the shaft is formed from one or more of plastic, carbon fiber, steel, aluminum, polyvinyl chloride (PVC), or fiberglass.

8. The pickleball holder of claim 1, wherein the shaft has a length that is greater than a diameter of a pickleball.

9. The pickleball holder of claim 1, wherein the shaft comprises:

a first sidewall including a first opening and a second opening near the first end;

a second sidewall including a first opening and a second opening near the first end and aligned with the first opening and the second opening of the first sidewall; and a center portion configured to fit between the first sidewall and the second sidewall and including an opening that extends from an edge of the center portion and around both the first opening and the second openings, the opening in the center portion configured to provide room for the spring mechanism to move around the first and second openings.

10. The pickleball holder of claim 9, wherein the spring mechanism comprises:

a first spring arm including a first end and a second end;

a second spring arm including a first end and a second end;

a first pin configured to couple the first end of the first spring arm to the first openings in the first sidewall and the second sidewall;

a second pin configured to couple the first end of the second spring arm to the second openings in the first sidewall and the second sidewall;

a hinge configured to couple the second end of the first spring arm to the second end of the second spring arm; and a spring configured to bias the first pin toward the second pin.

11. A pickleball holder comprising:

a shaft having a diameter sized to fit through one or more holes in a pickleball and having a length of five inches or more, the shaft including a first end and a second end;

a cap coupled to the first end of the shaft;

a cord plug coupled to the second end of the shaft;

a cord including a first end coupled to the cord plug and including a second end;

a link mechanism coupled to the second end of the cord and configured to couple to one or more of a net, a fence, or a structure; and a spring mechanism coupled to the shaft and configured to compress as the spring mechanism passes through a hole of the one or more holes in the pickleball and to expand when the spring mechanism is outside of the hole to releasably secure one or more pickleballs.

12. The pickleball holder of claim 11, wherein the spring mechanism comprises:

a wire bent to form a spring including spring arms; and openings formed in the shaft and sized to receive the spring arms.

13. The pickleball holder of claim 12, wherein the wire includes:

a coil portion;

a spring portion comprising one or more triangular-shaped portions forming the spring arms;

a release portion comprising an open end; and wherein the spring arms are configured to retreat into the shaft in response to pressure and to expand out of the openings in the shaft when the pressure is removed.

14. The pickleball holder of claim 11, wherein the shaft is formed from one or more of plastic, carbon fiber, steel, aluminum, polyvinyl chloride (PVC), or fiberglass.

15. The pickleball holder of claim 11, wherein the shaft comprises:

a first sidewall including a first opening and a second opening near the first end;

a second sidewall including a first opening and a second opening near the first end and aligned with the first opening and the second opening of the first sidewall; and a center portion configured to fit between the first sidewall and the second sidewall and including an opening that extends from an edge of the center portion and around both the first opening and the second openings, the opening in the center portion configured to provide room for the spring mechanism to move around the first and second openings.

16. The pickleball holder of claim 15, wherein the spring mechanism comprises:

a first spring arm including a first end and a second end;

a second spring arm including a first end and a second end;

a first pin configured to couple the first end of the first spring arm to the first openings in the first sidewall and the second sidewall;

a second pin configured to couple the first end of the second spring arm to the second openings in the first sidewall and the second sidewall;

a hinge configured to couple the second end of the first spring arm to the second end of the second spring arm; and a spring configured to bias the first pin toward the second pin.

17. A pickleball holder comprising:

a shaft formed from a hollow tube, the shaft including a first end and a second end, the shaft having a diameter sized to fit through one or more holes in a pickleball and having a length that is greater than a diameter of a pickleball, the shaft including at least one opening through the shaft near the first end;

a cord coupled to the second end of the shaft; and a spring mechanism at least partially within the shaft near the first end, the spring mechanism including one or more portions configured to compress into the at least one opening through the shaft in response to pressure and to extend through the at least one opening when the pressure is removed to secure one or more pickleballs.

18. The pickleball holder of claim 17, wherein the spring mechanism comprises a wire bent to form a spring including spring arms forming the one or more portions.

19. The pickleball holder of claim 17, wherein the shaft is formed from one or more of plastic, carbon fiber, steel, aluminum, polyvinyl chloride (PVC), or fiberglass.

20. The pickleball holder of claim 17, wherein the spring mechanism comprises:

a wire bent to form a spring including spring arms, the wire comprises:

a coil portion;

a spring portion comprising the one or more portions; and a release portion comprising an open end; and wherein the spring portion is configured to retreat into the at least one opening through the shaft in response to pressure and to expand out of the openings in the shaft when the pressure is removed.

* * * * *